US007458749B2

(12) United States Patent
Dickie

(10) Patent No.: US 7,458,749 B2
(45) Date of Patent: Dec. 2, 2008

(54) WASTEWATER EFFLUENT SHIELD

(76) Inventor: Allan Dickie, 12691 14th Ave., Surrey, BC (CA) V4A 1H3

( * ) Notice: Subject to any disclaimer, the term of this patent is extended or adjusted under 35 U.S.C. 154(b) by 234 days.

(21) Appl. No.: 11/363,866

(22) Filed: Feb. 27, 2006

(65) Prior Publication Data

US 2007/0053746 A1 Mar. 8, 2007

(51) Int. Cl.
*E03B 7/09* (2006.01)

(52) U.S. Cl. ..... 405/48; 405/157; 405/184.4

(58) Field of Classification Search ..... 405/43–44, 405/48, 157, 184.4

See application file for complete search history.

(56) References Cited

U.S. PATENT DOCUMENTS

| | | | | |
|---|---|---|---|---|
| 953,080 | A | 3/1910 | Wiggins | |
| 1,793,038 | A * | 2/1931 | Zimmermann | 404/26 |
| 3,715,958 | A * | 2/1973 | Crawford et al. | 52/21 |
| 3,938,285 | A * | 2/1976 | Gilbu | 52/20 |
| 4,182,583 | A | 1/1980 | McEntyre | |
| 4,721,408 | A | 1/1988 | Hewlett | |
| 4,904,112 | A | 2/1990 | McDonald | |
| 5,129,758 | A | 7/1992 | Lindstrom | |
| 5,160,218 | A * | 11/1992 | Hill | 405/157 |
| 5,441,363 | A | 8/1995 | Gray | |
| 5,511,903 | A | 4/1996 | Nichols et al. | |
| 5,785,454 | A | 7/1998 | Ringdal et al. | |
| 6,129,482 | A | 10/2000 | Ditullio | |
| 6,167,914 | B1 | 1/2001 | Koteskey | |
| 6,361,248 | B1 | 3/2002 | Maestro | |
| 6,749,367 | B1 | 6/2004 | Terry, III | |
| 2005/0074285 | A1 | 4/2005 | Burnes et al. | |

FOREIGN PATENT DOCUMENTS

| | | |
|---|---|---|
| WO | WO 81/01580 | * 11/1981 |

* cited by examiner

*Primary Examiner*—Frederick L Lagman
(74) *Attorney, Agent, or Firm*—Jellett Law Group PS; Matthew Jellett

(57) ABSTRACT

A wastewater effluents orifice shield. The shield has a roof section with a wall section. The wall section is configured to straddle and attached to a wastewater or effluents dispersion line. The dispersion line is configured with a plurality of discharge port's. The discharge port's jettison the effluents. The orifice shield diverts the effluents jettisoned from the dispersion line into a soil bed.

16 Claims, 4 Drawing Sheets

WASTEWATER EFFLUENT SHIELD

RELATED APPLICATIONS

This application claims priority benefit of Canadian Application Number 112433, filed Aug. 26, 2005.

DETAILED DESCRIPTION OF THE EMBODIMENTS

Figure 1:
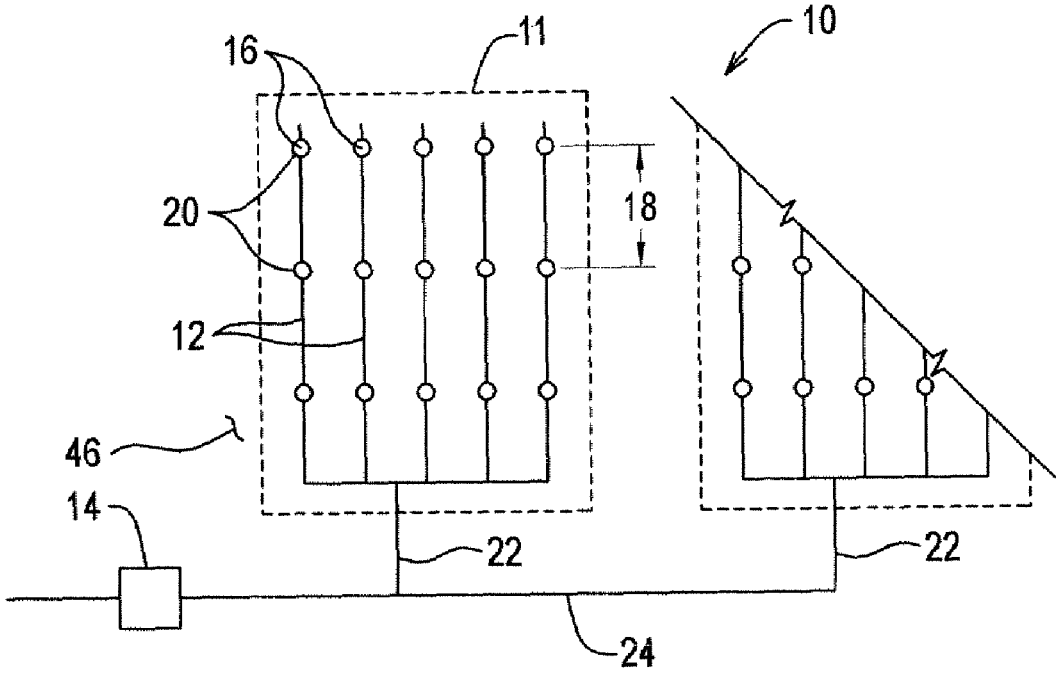
FIG. 1 is a plan view of the wastewater dispersion system.

The first embodiment as seen in FIG. 1 discloses a wastewater dispersion system 10 which in one form can be a leach field, a septic tank drainage field or a gray water field among others. The general purpose of the wastewater dispersion system 10 includes the periodic dispersion of effluent or used water which needs to be treated or disposed of into fields where more large scale standard municipal water treatment facilities are not used.

Figure 2:
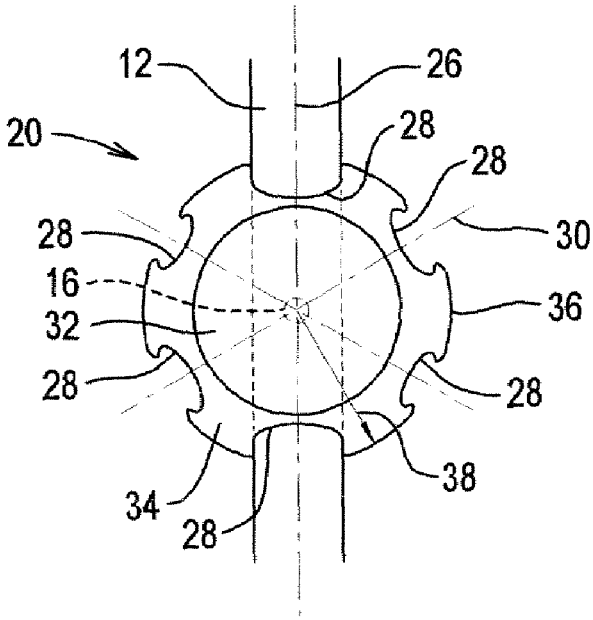
FIG. 2 is a plan detail view of the orifice shield.

The first embodiment of the wastewater dispersion system 10 includes (as seen in FIG. 1), a centrifugal pump 14 which is attached to a main line 24. Stemming from the main line 24 are feeder lines 22 which then supply the wastewater into dispersion lines 12. These dispersion lines are arranged above soil beds 11. The dispersion lines 12 have effluent orifice ports 16 (as seen in FIG. 2), which are spaced at a predetermined orifice spacing 18 as desired for adequate effluent dispersion. The centrifugal pump in this particular embodiment has various wastewater or effluent pumping periods which provide for the increase and decrease of the dispersion line 12 interior pressure. Pressure can range from between 0-60 lbs. psi depending on the periodic use of the dispersion line 12. To help disperse the effluent into the soil bed 11, an aggregate topping layer 46 is placed above the dispersion lines 12 to reduce the jet-like spray of the effluent escaping from the effluent orifice 16 when the interior pressure of the dispersion lines 12 reaches its high outflow level. The aggregate topping 46 also provides for catching of larger particulate matter which is contained within the wastewater.

During long-term usage of the dispersion lines 12, the pressure and outflow from the effluent orifices 16 will tend to force the aggregate topping 46 away from the general range of the effluent orifices 16. To keep the effluent orifice and effluent from pushing away the aggregate topping 46 and creating a void space above the effluent orifice 16, orifice shields 20 are provided for covering the orifices 16 thus keeping the effluent within, for example, the leach field or wastewater dispersion system 10. The orifice shield helps disperse or filter the effluent into the soil bed 11 for proper treatment.

Referring to FIG. 2, an orifice shield 20 is provided in the first embodiment over a standard effluent orifice 16, allowing the effluent in the dispersion line 12 to filter into the soil bed 11. The orifice shield 20 has a plurality of line through ports 28 which are semicircular and range in size from 1-2 inches in diameter. The orifice shield 20 is arranged so that the line through ports 28 straddle the dispersion line 12 which is arranged along a longitudinally aligned axis 26. The orifice shield through parts themselves are arranged along radially aligned diametrically opposed axis which can be aligned with the longitudinal axis 26 when the particular through port size is straddled over the dispersion line. Depending on the size of the dispersion line 12, the particular line through port 28 will be chosen to operably attach to the dispersion line 12 as will be discussed below. The first embodiment of the orifice shield 20 is provided with three line through port sizes to provide for varying dispersion line size attachment. The line through ports 28 are arranged on a radially aligned axis 30, which bisects the orifice shield 20 in the first embodiment along the diameter of the particular orifice shield. Thus, for example, the dispersion line 12 may have a nominal outer diameter of 1½ inches. The orifice shield 20 has available line through port 28 sizes of 1 inch, 1½ inch, and 2 inch diameter through ports. The user chooses the 1½ inch diameter line through port 28, which is sized to straddle and lock onto the nominal 1½ inch diameter dispersion line 12. The user arranges the orifice shield above the effluent orifice 16 to provide for containment of the wastewater as it shoots out of the effluent orifice 16.

Figure 3:
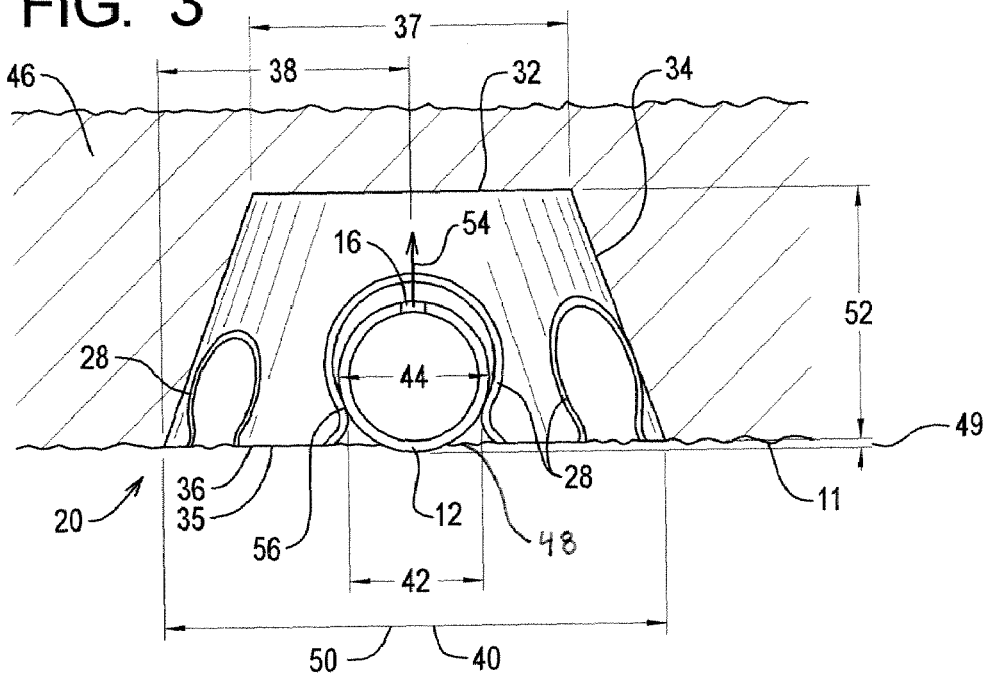
FIG. 3 is an elevational detail view of the orifice shield.

Referring to FIG. 3, the first embodiment of the orifice shield 20 includes a roof section 32 and a wall section 34 which combine to create a semispherical orifice shield arrangement. As previously mentioned, the dispersion line 12 has a nominal outer dimension which usually ranges between 1-2 inches, but could be larger or smaller in diameter depending on the design of the particular wastewater dispersion system. The orifice shield is sized to meet these dispersion line sizes as required. The orifice 16 in this particular arrangement is arranged at the topmost tangent of the dispersion line 12. The dispersion line as previously discussed, experiences large periodic internal pressures which direct the effluent dispersion flow 54 substantially vertical and may range depending on the amount of pressure within the dispersion line 12 to a vertical height of approximately 6 feet. The orifice shield 20 provides for redirection and containment of the effluent dispersion flow 54 down into the base soil bed 11 by allowing the effluent dispersion flow 54 to filter down into the bottom region of the orifice shield 20 as well as out into the top aggregate 46 through the unused dispersion line through ports 28. Other effluent filter ports may be provided as needed to adequately disperse the effluent.

Figure 4:
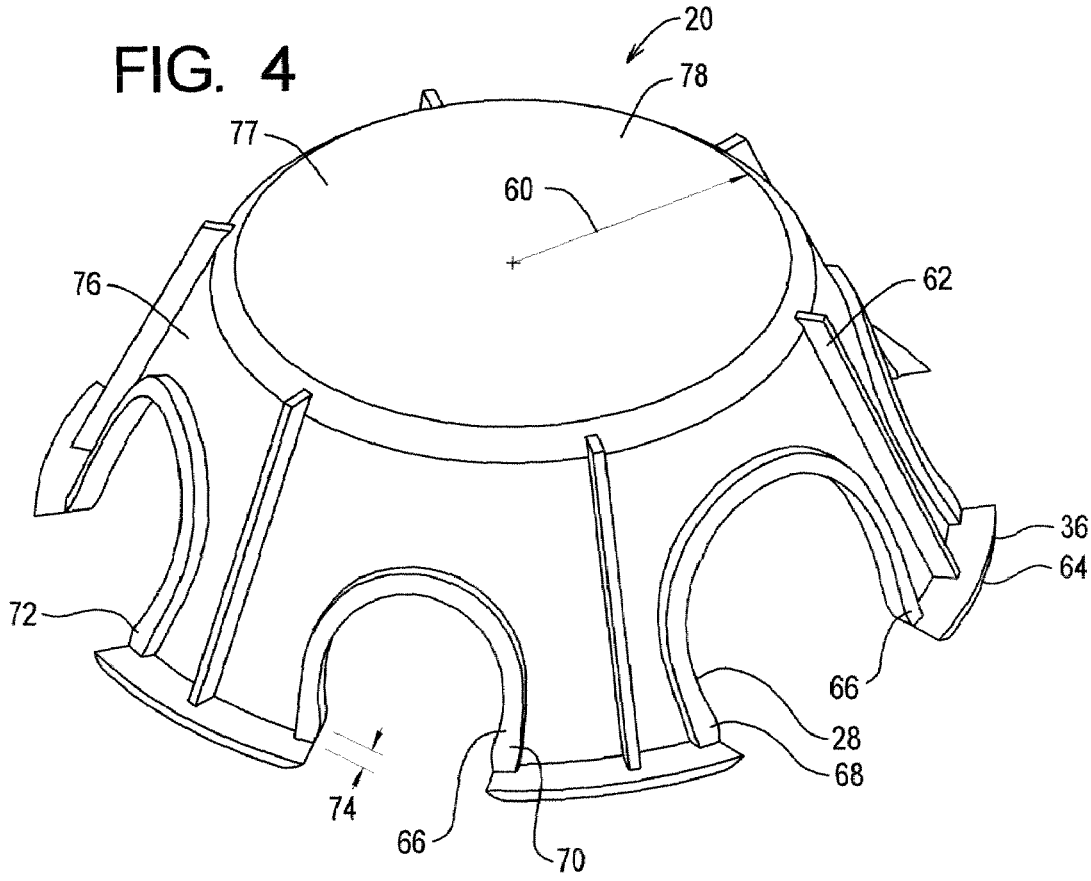
FIG. 4 is a perspective detail view of the orifice shield.
Figure 5:
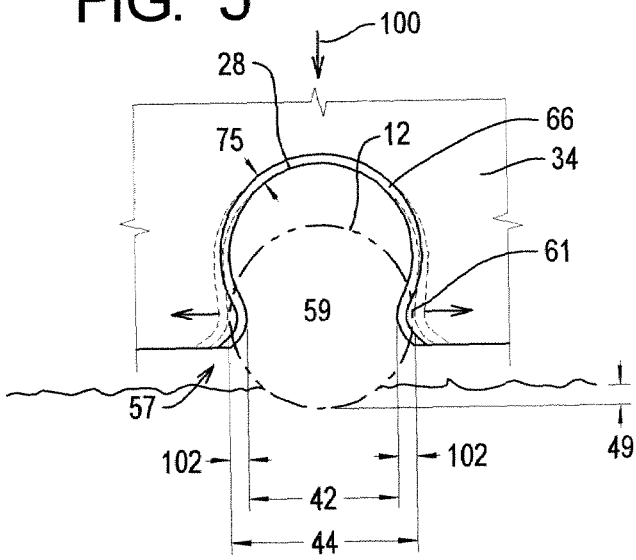
FIG. 5 is an elevational detail view of the through port.

To provide for adequate effluent dispersion flow 54 out of the orifice 16, the orifice shield 20 has a roof height 52, which is greater than the dispersion line diameter. This provides a ceiling space above the orifice 16 where the effluent can project vertically, hit the roof section 32 and then transition downward to filter out of the orifice shield 20 into the soil bed 11. The aggregate top covering 46 is placed at a depth greater than the overall height of the orifice shield roof 52 thus providing a certain amount of anchoring deadweight above the orifice shield 20 which provides for some resistance of the periodic effluent dispersion flow 54 out of the dispersion line 12 acting on the orifice shield. Additionally, the orifice shield 20 is held in place on the dispersion line 12 through the use of a locking mechanism or line impinging section 57 as seen in FIG. 5. Referring to both FIGS. 3 and 5, the line through ports 28 are configured to accept the chosen dispersion line diameters 44 through a reduced through port line opening 42. The through port 28 has a thickened section which is configured as a port collar 66. The port collar 66 has an increased radial collar depth 74 (as seen in FIG. 4), and an increased circumferential wall thickness 75 to provide for strengthening of the impinging action 56 which will be discussed further below.

The port collar 66 as well as the rest of the orifice shield 20 is constructed of a rigid but elastic material such as a polyvinyl chloride or even a nonyielding elastic composite material or metal/alloy material. The through port 28 having the line impinging section 57 locks onto the dispersion line 12 when the orifice shield 20 is pressed downward through an installation force 100 xxxxxxxx by the installer over the dispersion line outer diameter 44. The port collar 66 flexes circumferentially outwards a flex distance 102, which is the difference between the impinging section edge 59 and the outer diameter edge 61 of the dispersion line 12. After the orifice shield 20 has been installed over the dispersion line 12, the port collar 66 will apply a tangential pinching force action 56 (as seen in FIG. 3) against the outer surface of the line. The elastic spring force of the port collar 66 working to return to its original position is one way to provide a secure locking mechanism onto the dispersion line and acts to hold the orifice shield 20 longitudinally in line with the dispersion line 12.

Although the first embodiment of the orifice shield 20 uses a flexible port collar 66 within reduced through port line opening 42 to hold the orifice shield 20 in longitudinal position along the dispersion line 12, other locking mechanisms can be used. These include apparatuses such as set screws which can be screwed through the orifice shield 20 into the dispersion line 12 as well as through the use of tabular claws and the like which provide for grabbing onto the dispersion line 12.

Figure 6:
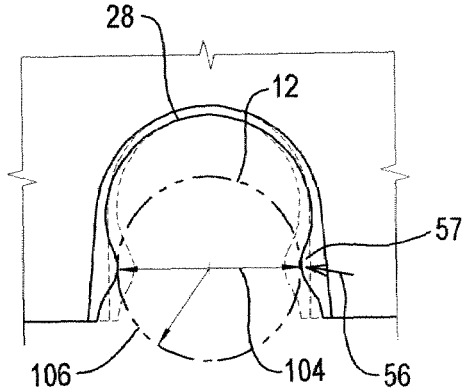
FIG. 6 is an elevational detail view of an alternative embodiment of the through port.

Furthermore, referring to FIG. 6, the locking/clamping action 56 of the impinging section 57 which provides for the tangential locking force of the through port 28 of the dispersion line 12, can be located at or below the horizontal midline diameter 104 of the dispersion line 12 and acts on the bottom semicircular section 106 of the line 12.

Referring back to FIG. 3, the orifice shield 20 in the first embodiment as previously mentioned has a closed upper roof section 32 and a semispherical wall section 34 with a plurality of line through ports 28 for varying dispersion line sizes 12. The wall section 34 has, in the first embodiment, an open bottom 35 with a perimeter wall section base circumference edge 36 or spread footing 64 as seen in FIG. 4. The first embodiment of the orifice shield 20 has an outer spread footing base diameter or shield stance 40 which is substantially greater than the dispersion line diameter. The shield stance 40 provides for stability of the orifice shield 20 in resisting overturning forces which may occur through shifting of the top aggregate 46 during the life of the wastewater dispersion system 10. Additionally, with large loads, the shield stance 40 or the spread footing width 64 provides for uniform load transfer 50 of the aggregate deadload onto the ground engaging location. This uniform deadload operates to resist as, previously mentioned, effluent dispersion upward forces 54 tending to raise the orifice shield 20 and provide for shifting in a radial manner about the longitudinal axis 26 of the dispersion line 12.

Referring to FIG. 4, the first embodiment of the orifice shield 20 seen in the semispherical configuration, as previously mentioned, has a semispherical roof section 78 which has a roof radius 60. The orifice shield 20 also has a semispherical perimeter wall section 76 and the shield membrane 77, as previously discussed in the first embodiment, is provided as an elastic polyvinyl chloride. The shield membrane 77 is of a thin-wall construction to provide for flexibility of wall membranes or wall section during installation of the orifice shield 20 over the dispersion line or dispersion line 12. The first embodiment also has a wall section buttress or wall stiffener 62, which provides for additional rigidity during forging of the thin-walled shield membrane 77 in this first embodiment.

Figure 7:
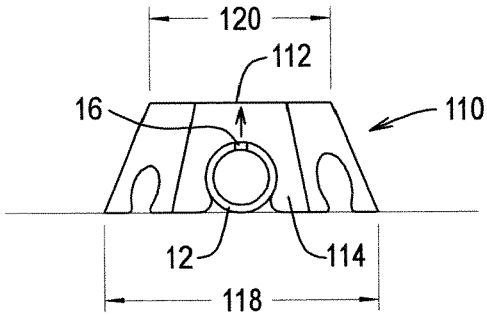
FIG. 7 is an elevational detail view of an alternative embodiment of the orifice shield.
Figure 8:
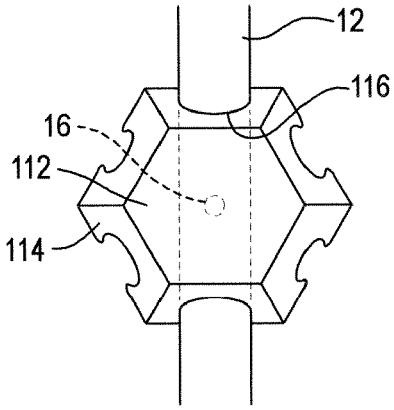
FIG. 8 is a plan detail view of an alternative embodiment of the orifice shield.

While the first embodiment shows the use of a semispherical orifice shield 20 (as seen in FIGS. 1-4), additional or alternative orifice shield configurations are also provided. These include the use of (as seen in the second embodiment, FIGS. 7 and 8), a hexagonal volume-type configuration 110 which has a flat hexagonal roof 112 with a six-sided hexagonal wall section 114. This second embodiment provides for a total of three alternative line through port sizes 116 which can range between, as previously discussed in the current embodiment, 1-2 inches in diameter depending on the desired dispersion line configuration. The second hexagonal embodiment 110 has a wide stance base 118 which is substantially wider than the dispersion line 12 diameter and is also wider than the flat roof width 120.

Figure 9:
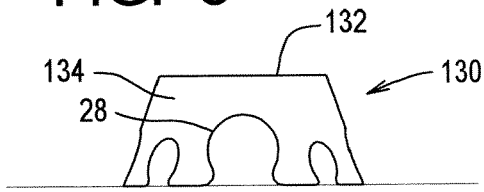
FIG. 9 is an elevational detail view of an alternative embodiment of the orifice shield.
Figure 10:
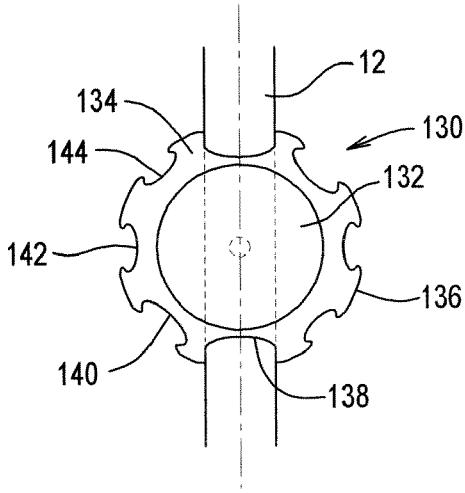
FIG. 10 is a plan detail view of an alternative embodiment of the orifice shield.

A third alternative embodiment of the orifice shield 20 is shown in FIG. 9 and 10 as a truncated conical shield 130 with a four through port arrangement. This alternative embodiment discloses the use of a large number of through ports 28 for a wider range of dispersion line adaptability. The truncated conical shield 130 has in this current alternative embodiment a flat circular roof 132 with a conical wall section 134. The outer circumferential perimeter 136 of the truncated conical shield 130 is great enough to provide for arrangement of four varying port sizes. In this alternative embodiment, these port sizes range from the largest of a 2 inch diameter through port 138 to the next largest through port of a 1¾ inch diameter through port 140, to medium-sized through port at 1¼ inch diameter through port 142 to the currently smallest diameter through port at 1 inch diameter 144. As previously mentioned, these through port diameters will vary depending on the desired adaptability to the various dispersion lines 12 within the wastewater dispersion system 10 such as the leach field or gray water field.

Figure 4A:
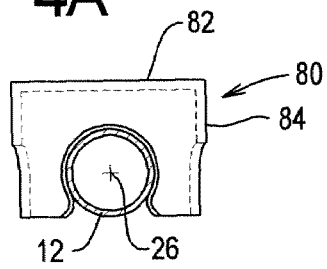
FIG. 4A is in elevational detail view of an alternative embodiment of the orifice shield.
Figure 4B:
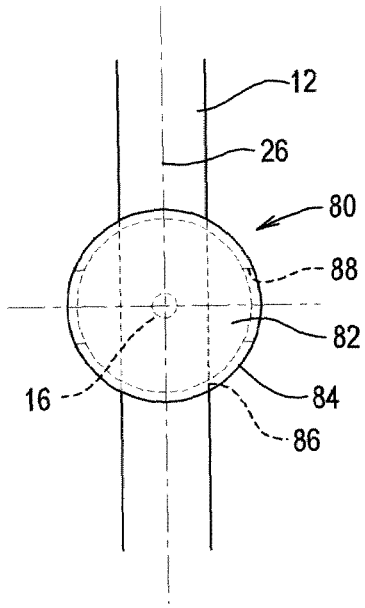
FIG. 4B is a plan detail view of an alternative embodiment of the orifice shield.

In an additional alternative embodiment, a cylindrical orifice shield 80 (as seen in FIGS. 4A and 4B) is provided. This cylindrical orifice shield 80 has a cylindrical perimeter wall section 84 with a cylindrical or circular roof section 82. The cylindrical orifice shield 80 in this alternative embodiment has two preconfigured dispersion line through ports, 86 and 88. Both are arranged radially to provide for alignment with the dispersion line longitudinal axis 26 as previously discussed.

Figure 11:
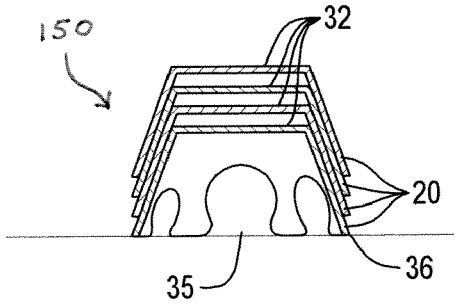
FIG. 11 is an elevational sectional view of an assembly of the present embodiments.

Prior to use, the orifice shields can be stacked or stored in a nested position 150 as seen in FIG. 11. Because the orifice shields have a larger diameter perimeter edge 36 than the roof 32 and thus are arranged in somewhat of a conical or semispherical configuration, and since the bottom perimeter edge 36 has an opening 35, the shields can be stacked or placed one on top of the other into a nested type assembly or storage configuration 150.

I claim:

1. An orifice shield comprising:

a. a roof section supported by a wall section;

b. said wall section configured to straddle a dispersion line; said dispersion line arranged along a longitudinally aligned central axis and comprising an outer diameter and a discharge port;

c. said wall section further comprising a ground engaging portion; a first pair of laterally aligned ports arranged to hold said orifice shield in longitudinal and rotational alignment with said dispersion line; and a second pair of laterally aligned ports.

2. The orifice shield according to claim 1 wherein said wall section further comprises: a substantially hemispherical shell, said roof section further comprising an upper region of said hemispherical shell; said ground engaging portion further comprising a lower edge of said hemispherical shell.

3. The orifice shield according to claim 1 wherein said wall section further comprises: a substantially conical shell, said roof section further comprising a truncated flat portion of said conical shell; said ground engaging portion further comprising a lower edge of said conical shell.

4. The orifice shield according to claim 1 wherein said wall section further comprises: a substantially cylindrical shell, said roof section further comprising a circular portion having a diameter matching said cylindrical shell diameter; said ground engaging portion further comprising a lower edge of said cylindrical shell.

5. The orifice shield according to claim 1 wherein said wall section further comprises: a substantially hexagonal shell; said roof section further comprising a hexagonal section matching said hexagonal shell; said ground engaging portion further comprising a lower edge of said hexagonal shell.

6. The orifice shield according to claim 1 wherein said orifice shield further comprises: a substantially cubic arrangement.

7. The orifice shield according to claim 1 wherein said first and second pair of laterally aligned ports comprise: a pair of semicircular openings arranged along a bottom portion of said wall section and each pair of semicircular openings spaced diametrically opposite from one another along a radially aligned axis.

8. The orifice shield according to claim 1 wherein said outer wall section further comprises a third pair of laterally aligned ports; said first, second, and third, pairs of laterally aligned ports arranged about a vertically aligned central axis centered about said roof section.

9. The orifice shield according to claim 8 wherein said first pair of laterally aligned ports further comprise: an outer diameter of about 1 inch.

10. The orifice shield according to claim 8 wherein said second pair of laterally aligned ports further comprise: an outer diameter of about 1½ inches.

11. The orifice shield according to claim 8 where said third pair of laterally aligned ports further comprise: an outer diameter of about 2 inches.

12. An apparatus to disperse wastewater exiting from a dispersion line, said apparatus comprising:

a. a semispherical roof section supported by a cylindrically truncated wall section, said wall section configured to straddle a dispersion line, said dispersion line comprising a cylindrical diameter, at least one discharge port arranged along the top edge of said dispersion line;

b. said wall section further comprising: a first pair of diametrically opposed radially aligned ports each comprising a first semicircular opening, each having a first outer diameter comprising a first center point located vertically from a bottom edge of said cylindrically truncated wall section about equal to or less than one half of said first outer diameter;

c. a second pair of diametrically opposed radially aligned ports each comprising a second semicircular opening, each having a second outer diameter comprising a second center point located vertically from the bottom edge of said cylindrically truncated wall section about equal to or less than one half of said second outer diameter;

d. a third pair of that diametrically opposed radially aligned ports each comprising a third semicircular opening, each having a third outer diameter comprising a third center point located vertically from the bottom edge of said cylindrically truncated wall section about equal to or less than one half of said third outer diameter.

13. The apparatus according to claim 12 wherein said wall section further comprises: said first outer diameter comprising a 1 inch nominal distance; said second outer diameter comprising a 1¼ inch nominal distance; said third outer diameter comprising a 1½ inch nominal distance.

14. The apparatus according to claim 12 wherein said wall section further comprises said first outer diameter comprising a nominal distance from about ½ inch to about 1 inches in diameter.

15. The apparatus according to claim 12 wherein said wall section further comprises said second outer diameter comprising a nominal distance from about 1 inches to about 1½ inches in diameter.

16. The apparatus according to claim 12 wherein said wall section further comprises said third outer diameter comprising a nominal distance from about 1½ inches to about 2 inches in diameter.

* * * * *